US011215357B1

(12) United States Patent
Kittelson

(10) Patent No.: US 11,215,357 B1
(45) Date of Patent: Jan. 4, 2022

(54) FIRE STUMP

(71) Applicant: Mark W. Kittelson, Glenwood, MN (US)

(72) Inventor: Mark W. Kittelson, Glenwood, MN (US)

( * ) Notice: Subject to any disclaimer, the term of this patent is extended or adjusted under 35 U.S.C. 154(b) by 301 days.

(21) Appl. No.: 16/579,250

(22) Filed: Sep. 23, 2019

Related U.S. Application Data

(60) Provisional application No. 62/734,985, filed on Sep. 21, 2018.

(51) Int. Cl.
*F24B 1/193* (2006.01)
*F23B 60/00* (2006.01)
*F23H 17/08* (2006.01)

(52) U.S. Cl.
CPC ..... *F23B 60/00* (2013.01); *F23H 17/08* (2013.01); *F24B 1/193* (2013.01)

(58) Field of Classification Search
CPC ..... F24B 1/193
See application file for complete search history.

(56) References Cited

U.S. PATENT DOCUMENTS 2,391,518 A * 12/1945 Sharpe ..... F23H 13/02 126/541
4,131,108 A * 12/1978 Bauder ..... F24B 1/193 126/298
4,344,412 A 8/1982 Perrin
5,076,253 A * 12/1991 LindstroOlle ..... F23G 5/42 126/540
D343,450 S * 1/1994 Doty ..... D23/410
5,722,390 A * 3/1998 Hannebaum ..... F24B 1/193 126/152 B
5,842,465 A 12/1998 Cassidy
6,363,927 B2 4/2002 Haynes et al.
6,405,724 B1 * 6/2002 Richard ..... F24B 1/193 126/152 R
6,637,713 B1 * 10/2003 Kleve ..... F24B 1/193 126/152 B
8,312,874 B2 11/2012 Dupont
8,870,133 B1 * 10/2014 Brown ..... F24B 1/181 248/156
D731,636 S 6/2015 Hills
9,357,875 B1 * 6/2016 Guiliano ..... A47J 36/26
9,532,679 B1 * 1/2017 Besch ..... A47J 33/00
(Continued)

*Primary Examiner* — David J Laux
(74) *Attorney, Agent, or Firm* — Albert W. Watkins

(57) ABSTRACT

A fire stump holds firewood and similar combustibles in a near-vertical stable position. Firewood is end-stacked upon a ground engaging base, further stabilizing the base. An upper generally planar firewood support is inset interiorly from the base, providing sufficient tilt to hold a plurality of stacked wood in an inverted funnel configuration. The upper firewood support has a perforate center defining a chimney hole and a perimeter defining a plurality of concave arcuate cut-outs that serve as firewood supports. A riser extends between the ground engaging base and upper firewood support, holding the two in parallel but vertically offset planes. In a most preferred embodiment, the ground engaging base and upper firewood support are stamped from a common sheet of metal, with the upper firewood support circumscribed in the original sheet of metal by the ground engaging base.

20 Claims, 2 Drawing Sheets

(56) References Cited

U.S. PATENT DOCUMENTS

| | | | | |
|---|---|---|---|---|
| 10,982,164 | B2 * | 4/2021 | Molburg | C10L 11/04 |
| 2010/0326423 | A1 * | 12/2010 | Dupont | F24B 1/193<br>126/540 |
| 2011/0000476 | A1 * | 1/2011 | Kleve | F24B 1/193<br>126/152 B |
| 2011/0174286 | A1 | 7/2011 | Carlson | |
| 2012/0156627 | A1 * | 6/2012 | Koch | F24B 1/193<br>431/2 |
| 2013/0068210 | A1 * | 3/2013 | Koelzer | F24B 1/193<br>126/152 B |
| 2014/0060516 | A1 * | 3/2014 | Delaquis | F24B 1/193<br>126/298 |

* cited by examiner

FIRE STUMP

CROSS REFERENCE TO RELATED APPLICATIONS

The present application claims the benefit of U.S. provisional patent application 62/734,985 filed Sep. 21, 2018 of like title and inventorship, the teachings and entire contents which are incorporated herein by reference.

BACKGROUND OF THE INVENTION

1. Field of the Invention

The present invention pertains generally to a firewood stand designed to hold firewood and similar combustibles in a near-vertical stable position.

2. Description of the Related Art

Firewood may be burned to provide both pleasure and heat in a variety of settings and fixtures. For exemplary and non-limiting purposes, a wood stove or fireplace within a building or other shelter may be configured to provide heat to warm the structure. In many cases, this same fire may also be designed to allow persons to view the burning wood for the calming, comfort, and aesthetic pleasure normally derived. Similar benefits may be attained from a campfire or other recreational fire, which might most commonly be created outside of any structure.

Both when starting the fire and during subsequent combustion of the firewood, there are several preferred objectives. One of these is to permit good air flow in a generally vertical direction. Air is an essential component of a wood fire, and in nearly all campfires and many fireplaces and wood stoves, the air is drawn to the burning wood by the heating of the air immediately adjacent to the wood. Insufficient air leads to excessive smoke, soot, creosote, and other undesirable emissions. To replenish the oxygen and thereby keep the fire burning, the used air must be removed and replaced by fresh air. Since hot air rises above cold air, as aptly demonstrated by hot air balloons, the fire may provide all of the energy required to move the air simply as a result of the heat released during combustion. In order to do so, there must be a good air flow path vertically that both allows the cold air to move past the burning wood and then, when thus heated, to continue to rise above the fire and out of the way of the incoming fresh air.

A second preferred objective is to keep the firewood clustered together. When the wood is burning, it releases a substantial amount of energy in the form of infrared radiation. If this radiant energy is released into the surroundings, the fire will be much harder to start and keep burning. In fact, one common way of extinguishing a fire is to knock the firewood down into a single layer on the ground.

However, when firewood is clustered in closed proximity, then the radiant energy released from one piece of firewood may in turn be absorbed by an adjacent piece of firewood. Preserving more of this radiant energy helps to increase the peak temperature and efficiency of the fire. In turn, the color of the flames will be much brighter, typically bringing the characteristic blue, yellow, and orange flames, along with glowing red firewood. By preserving the energy, it is also much easier to start the fire using kindling. The kindling can heat the firewood more efficiently, and then when even a small portion of the firewood begins to burn, this conservation of radiant energy helps to ensure that there is sufficient energy to allow the fire to grow. Finally, when the wood is clustered, it will also shelter kindling from gusts of wind that might put out the kindling before the firewood has even had a chance of heating sufficiently.

While these objectives are known and recognized, the most common ways of generating this type of fire lack ease. In some cases, common ways of generating this type of fire can be dangerous.

One known technique is to arrange the firewood in a generally conical, nearly vertical arrangement resembling the geometry of an inverted funnel. This arrangement, where the wood is leaning toward a center vertical axis, provides some stability by having opposed pieces of firewood balance against each other. In addition, the base of the fire is relatively more open, allowing cool air to be drawn easily into the fire, while near the top of the fire the wood is much closer together, retaining infrared and convected thermal energy within the firewood. This also enables the fire starter to collect small twigs, paper, leaves, pine needles, and other kindling within the very center and base of the arrangement, where such kindling will have maximum benefit in starting the fire. Unfortunately, as may be appreciated the balancing of opposed pieces of wood is a bit precarious. First, the wood must be of similar dimension to be able to balance. This means the fire starter must select wood that can be balanced, and then must arrange the wood accordingly. In other words, a large diameter and relatively longer piece of firewood cannot oppose a short and small diameter piece. Unfortunately, even when properly arranged, as the firewood burns it may shift and collapse. This can be somewhat more dangerous, since burning pieces of firewood may fall out of the fire, potentially starting a fire in the surroundings or burning an unsuspecting person. Once the burning firewood collapses, it will be immensely more difficult to reconstruct the conical geometry, meaning that after a collapse, the fire will most commonly be burned in a short pile, losing both efficiency and aesthetic value. As a corollary, adding wood to this conical structure will often topple an otherwise at least temporarily stable structure. Furthermore, even when perfectly assembled, the top or apex of the cone is almost always very tightly packed, meaning there is not good airflow through this conical top, where a slightly more open "chimney" would allow better airflow even at the top.

One alternative is to use a much larger in diameter but relatively shorter stump of wood to define the center of the fire. In this case, a fire starter will arrange the wood around the stump, again in a conical geometry. As long as the stump has a much larger diameter, the stump will provide a solid support and will remain in place even after the surrounding wood has completely burned away. In addition, when the ground is wet the top of the stump can serve as a convenient and much drier location for tinder to be stacked and ignited, to start the firewood burning.

Unfortunately, there are still a few drawbacks, the least of which is the requirement for there to be a stump of disproportionate size and diameter. In addition, the stump will fill the center of the fire, both blocking the flow of air in the center and also taking up space that might otherwise be filled with kindling. Further, the stump will in most cases be at least partially rounded on the exterior, in nearly all cases presenting a convex exterior diameter. This means that firewood intended to be leaned against this stump will still be prone to sliding and toppling down, since if the firewood starts to shift along the outer perimeter of the stump, it will gain energy and thus be more likely to topple. So, while the stump solves some of the problems, there still remain many other problems that would preferably be solved.

Recognizing the need for improved apparatus to assist with the arrangement and burning of firewood, a number of artisans have developed various racks and grates such as might be fabricated from iron or steel. Exemplary U.S. and Foreign patents and published applications, the teachings which are incorporated herein by reference, include: U.S. Pat. No. 5,076,253 by Lindstro, entitled "Burner For wood logs"; U.S. Pat. No. 5,722,390 by Hannebaum, entitled "Fireplace wood holder"; U.S. Pat. No. 6,637,713 by Kleve et al, entitled "Log Supporting Apparatus"; U.S. Pat. No. 8,870,133 by Brown, entitled "Bonfire Stand"; U.S. Pat. No. 8,312,874 by Dupont, entitled "Campfire support unit"; U.S. Pat. No. 9,357,875 by Guiliano, entitled "Combination outdoor cooking and firewood support apparatus"; U.S. Pat. No. 9,532,679 by Besch, entitled "Camp Fire aid system"; 2010/0326423 by Dupont, entitled "Campfire support unit"; 2011/0174286 by Carlson, entitled "Vertical Campfire device"; Des. 343,450 by Doty, entitled "Wood holder for fireplace"; and Des. 731,636 by Hills, entitled "Spider Fireplace Grate". While these patents have definitely greatly improved upon the stacked and arranged firewood, they also suffer from a number of drawbacks that would desirably be eliminated.

Some of these designs, such as the Guiliano patent, still incorporate a hoop or ring at the top. As with the short stump of wood described herein above, a hoop is inherently unstable, and so offers limited improvement over the stump or conical arrangements of stacking wood, while still requiring the purchase of the firewood support apparatus.

Many of these apparatus are quite large, and may not be stacked. While this is not a limitation when installed into a fire ring or the like, the apparatus must be inventoried, stocked in retail outlets and warehouses, and shipped from manufacturing site to warehouse or retail location. In all of these situations of inventory and shipping, packing density relates inversely to cost. Consequently, for exemplary purpose only, while the Hannebaum, Carlson, and Doty apparatuses may each perform admirably, they do not stack tightly, thereby greatly increasing inventory and shipping costs.

A few of the apparatus such as the Brown and Kleve patents are designed for assembly once delivered to the point of use. Due to the carefully thought out designs, in nearly all cases these apparatuses will perform admirably. However, in the rare event that they are not properly assembled or are undesirably jarred or unbalanced during a fire such as by the shifting or breaking of a piece of firewood during combustion, a person could be seriously burned when the apparatus collapses. Further, the assembly will not be intuitive to all persons, leaving some persons extremely frustrated.

Some of the apparatus are designed with long unsupported arms or legs that can easily overload and break or collapse, again presenting a hazard to those in immediate vicinity of a fire. Exemplary is the Dupont patent. Others, such as Lindstro, present such a large web or matrix of metal that tends to obscure the fire and prevents access for maintenance of the fire or roasting of marshmallows.

Additional patents of varying relevance, the relevant teachings and contents which are incorporated herein by reference, include: U.S. Pat. No. 4,344,412 by Perrin, entitled "Log supporting rack for use in a fireplace"; U.S. Pat. No. 5,842,465 by Cassidy, entitled "Stackable fireplace grates"; and U.S. Pat. No. 6,363,927 by Haynes et al, entitled "Log Burning Device".

In addition to the foregoing patents, Webster's New Universal Unabridged Dictionary, Second Edition copyright 1983, is incorporated herein by reference in entirety for the definitions of words and terms used herein.

As may be apparent, in spite of the enormous advancements and substantial research and development that has been conducted, there still remains a need for a low cost, light weight, durable, readily stacked and inventoried or shipped, and easily and intuitively used fire wood support that retains fire access and visibility while providing a reliable and stable support for the firewood.

SUMMARY OF THE INVENTION

In a first manifestation, the invention is in combination a fire stump and firewood. The fire stump comprises a sheet steel planar ground engaging base having an open center and four longitudinally extensive base support members. Each of the four longitudinally extensive base support members is integral with and perpendicular to adjacent ones of the four longitudinally extensive base support members and thereby defines square interior and exterior perimeters of the ground engaging base and four corners. Each one of the four corners is located between each one of the four longitudinally extensive base support members. A sheet steel planar upper firewood support is stamped from the sheet steel planar ground engaging base to thereby define at least a portion of the base open center. The upper firewood support has a perforate center defining a chimney hole and a perimeter defining a plurality of concave arcuate firewood supports. Each one of a pair of adjacent firewood supports is separated from each other by a firewood separator more distal to the perforate center than each one of the pair of adjacent firewood supports. A riser rigidly couples and displaces the sheet steel planar upper firewood support to a plane displaced above and parallel with a plane defined by the sheet steel planar ground engaging base. The riser has four longitudinally extensive riser members, each one coupling at a first end with a one of the firewood separators and at a second distal end with the sheet steel planar ground engaging base adjacent a one of the four corners. The firewood comprises a generally cylindrical wooden body defining first and second distal ends. The firewood first end rests on the ground engaging base. The firewood second end rises from the ground engaging base to an elevation above the upper firewood support and more distal to the ground engaging base. A side of the generally cylindrical wooden body rests within a one of the plurality of concave arcuate firewood supports.

In a second manifestation, the invention is a fire stump. The fire stump comprises a sheet steel ground engaging base having an open center. A sheet steel upper firewood support is stamped from the sheet steel ground engaging base to thereby define at least a portion of the base open center. The upper firewood support has a perforate center defining a chimney hole and a perimeter defining a plurality of concave arcuate firewood supports. Each one of a pair of adjacent firewood supports is separated from each other by a firewood separator more distal to the perforate center than each one of the pair of adjacent firewood supports. A riser rigidly couples and displaces the sheet steel upper firewood support to a plane displaced above and parallel with a plane defined by the sheet steel ground engaging base.

In a third manifestation, the invention is in combination a fire stump and firewood. The fire stump comprises a sheet steel ground engaging base having an open center. A sheet steel upper firewood support is stamped from the sheet steel ground engaging base to thereby define at least a portion of the base open center. The upper firewood support has a perforate center defining a chimney hole and a perimeter defining a plurality of concave arcuate firewood supports. Each one of a pair of adjacent firewood supports is separated from each other by a firewood separator more distal to the perforate center than each one of the pair of adjacent firewood supports. A riser rigidly couples and displaces the sheet steel upper firewood support to a plane displaced above and parallel with a plane defined by the sheet steel ground engaging base. The firewood comprises a generally cylindrical wooden body defining first and second distal ends. The firewood first end rests on the ground engaging base. The firewood second end rises from the ground engaging base to an elevation above the upper firewood support and more distal to the ground engaging base. A side of the generally cylindrical wooden body rests within a one of the plurality of concave arcuate firewood supports.

OBJECTS OF THE INVENTION

Exemplary embodiments of the present invention solve inadequacies of the prior art by providing a ground engaging base upon which firewood may set, an upper firewood support that is inset from the base upon which firewood will lean, and a riser between the ground engaging base and upper firewood support. In a most preferred embodiment, the ground engaging base and upper firewood support are stamped from a common sheet of metal, with the upper firewood support circumscribed in the sheet of metal by the ground engaging base.

The present invention and the preferred and alternative embodiments have been developed with a number of objectives in mind. While not all of these objectives are found in every embodiment, these objectives nevertheless provide a sense of the general intent and the many possible benefits that are available from various embodiments of the present invention.

A first object of the invention is to provide good air flow in a generally vertical direction when starting the fire and during subsequent combustion of the firewood. This may preferably be a "chimney effect," providing efficient and complete combustion with reduced smoke, soot, creosote, and similar emission. A second object of the invention is to keep the firewood clustered in closed proximity to preserve radiant energy and thereby increase the peak temperature and efficiency of the fire, which in turn improves the aesthetic appearance by yielding brighter and more colorful flames, typically bringing the characteristic blue, yellow, and orange flames, along with glowing red firewood. As a corollary thereto, by preserving the energy, it is also much easier to start the fire using kindling. As a further corollary, when the wood is clustered, it will also shelter kindling from gusts of wind that might put out the kindling before the firewood has even had a chance of heating sufficiently. Another object of the present invention is to retain good access to the fire for convenient and fast lighting, and easy restocking with firewood during burn. As a corollary thereto, the fire will preferably be highly visible, both to assist with maintenance of the fire and to obtain the full aesthetic benefit. A further object of the invention is to provide an elevated support for tinder to ignite the wood when ground is wet. Yet another object of the present invention is to provide a low cost, readily fabricated, light weight, durable, readily stacked and inventoried or shipped, and easily and intuitively used fire wood support that provides a reliable and stable support for the firewood.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
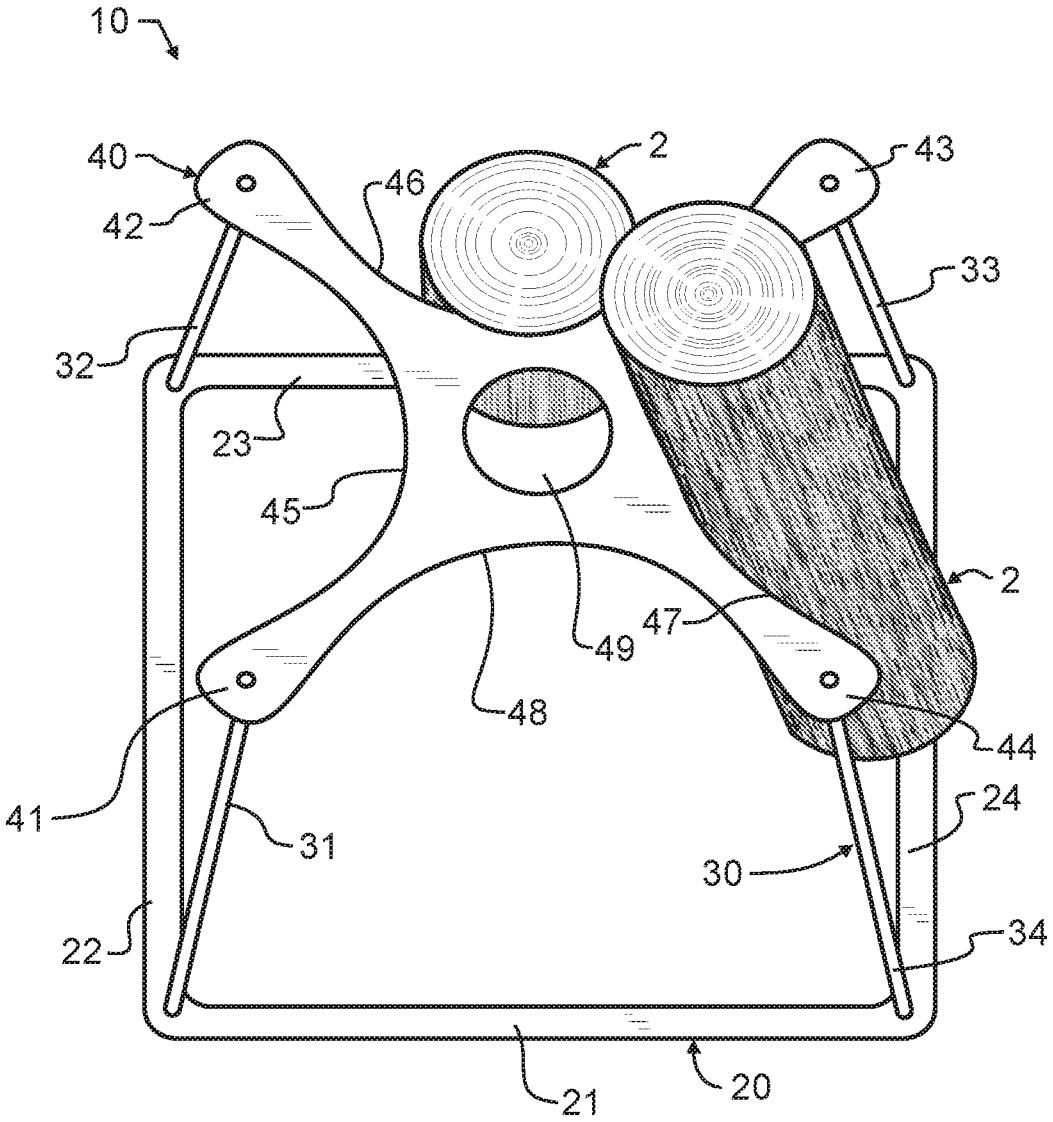
FIG. 1 illustrates a preferred embodiment fire stump designed in accord with the teachings of the present invention in further combination with two pieces of firewood, from projected view.
Figure 2:
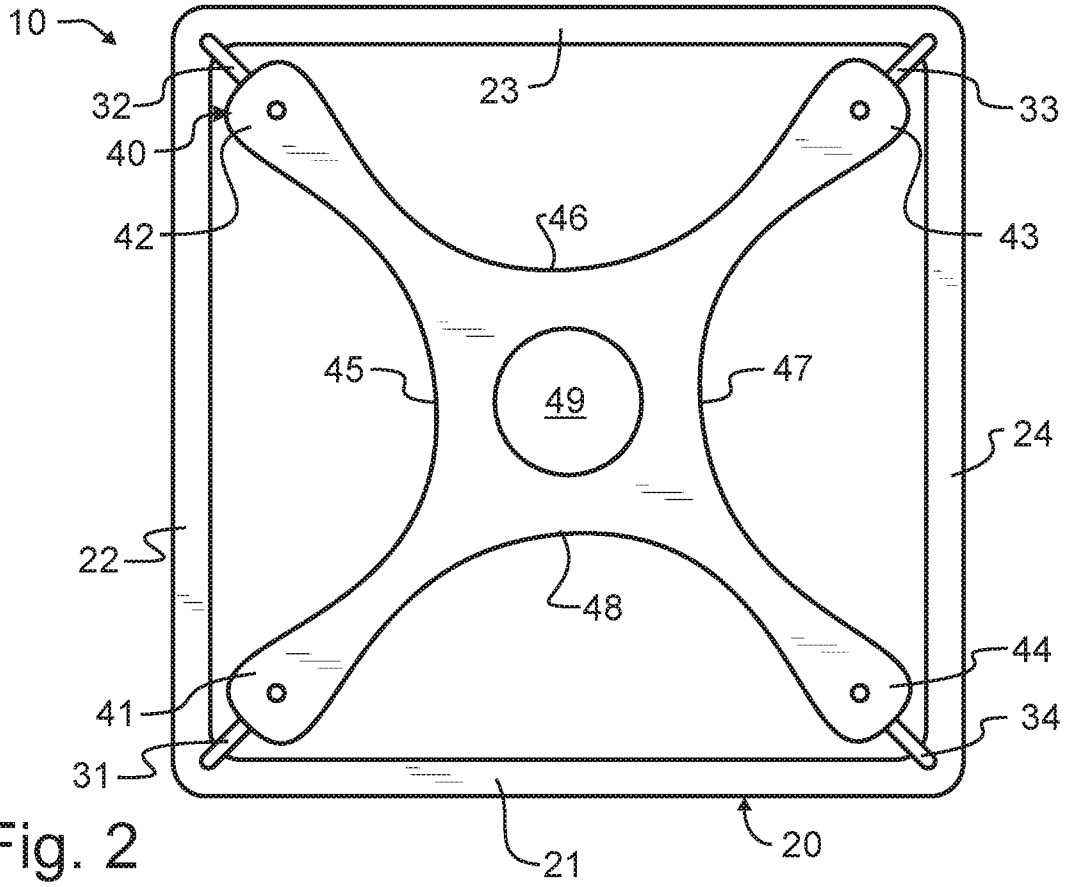
FIGS. 2 and 3 illustrate the preferred embodiment fire stump of FIG. 1 from top plan and side elevational views, respectively.
Figure 3:
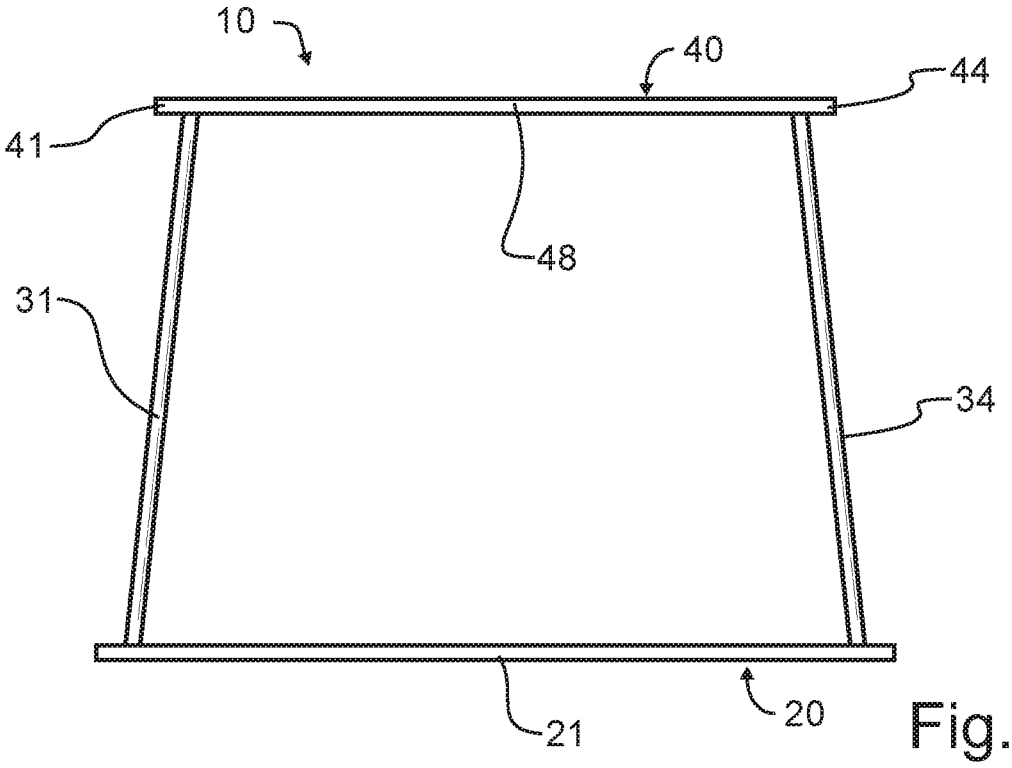

Manifested in the preferred embodiment illustrated in FIGS. 1-3, the present invention provides fire stump 10 designed to hold firewood 2 and similar combustibles in a near-vertical stable position. A ground engaging base 20 provides a stable support surface, further stabilized by firewood 2 that rests in part thereupon. An upper firewood support 40 upon which firewood 2 leans is inset from the base, providing sufficient tilt to hold a plurality of stacked wood 2 in a conical configuration. A riser 30 runs between and separates ground engaging base 20 from upper firewood support 40.

With specific reference to FIG. 3, ground engaging base 20 and upper firewood support 40 are separated from each other by riser 30. With specific reference to FIG. 2, most of upper firewood support 40 extends from a centrally located vertical axis that would pass through the center of centrally located chimney hole 49 by a distance less than a distance than much of ground engaging base 20 will be spaced from that same axis. With specific reference to FIG. 1, this means that firewood 2 may be placed in a nearly vertical orientation with the tops inclined inward toward one another by simply resting the bottom end of the firewood on top of ground engaging base 20 and then leaning an intermediate portion of the firewood against upper firewood support 40. A slight tilt of firewood 2 as illustrated in FIG. 1, with the top end of firewood 2 closer to the centrally located vertical axis than the bottom end will ensure that the wood stays leaning against preferred embodiment fire stump 10. In addition, since the bottom end of firewood 2 is resting upon ground engaging base 20, and as long as the length of firewood 2 is not too much greater than the height of preferred embodiment fire stump 10, preferred embodiment fire stump 10 will remain stable and upright, and will not be prone to toppling.

Ground engaging base 20 may comprise a variety of suitable geometries in alternative embodiments that are different from illustrated in the present Figures. In preferred embodiment fire stump 10, longitudinally extensive base support members 21, 22, 23, 24 are provided in a generally square configuration. Each of these longitudinally extensive base support members 21, 22, 23, 24 are, as the name implies and the Figures illustrate, quite long and relatively thin and narrow. Being both thin and narrow provides several benefits, including: low material consumption, which translates into both lower materials cost and lighter weight; a more stable support for the bottom end of firewood 2, since the metal does not rise unduly above the earth surface; and better chance of stable ground engagement, since preferred embodiment fire stump 10 may be shifted about the surface of the ground to avoid obstacles such as rocks or other protrusions. While it may be apparent that ground engaging base 20 is not essential to good ground support or even to supporting firewood 2, it is highly beneficial to prevent preferred embodiment fire stump 10 from toppling when the firewood 2 is being placed against fire stump 10. In an alternative embodiment without ground engaging base 20, if firewood 2 is significantly heavier than fire stump 10, the slight tilt of firewood 2 would topple fire stump 10.

In preferred embodiment fire stump 10, longitudinally extensive base support members 21, 22, 23, 24 are quite long and relatively thin and narrow. In a most preferred method of fabrication, ground engaging base 20 is of unitary construction, and may be fabricated from standard sheet stock such as by stamping using suitable dies, substantially reducing the labor and difficulty of fabrication. The stamping operation will typically define the outer shape or perimeter thereof, and may simultaneously or in prior or subsequent stamping or forming operations define the interior opening as well. This means that a single forming operation or sequence, in the preferred embodiment a stamping operation, can form ground engaging base 20. Furthermore, in alternative embodiments the square outer perimeter and interior may be replaced by different geometries that may be of different shape, including non-linear and even artistic geometry. In view of the stamping, ground engaging base 20 is economical to produce, with only very minimal labor required.

While stamping is a most preferred method of fabrication, in further exemplary and non-limiting alternative embodiments ground engaging base 20 may be fabricated from rod or larger diameter wire that is welded or otherwise securely bonded into a suitable base geometry. Furthermore, while ground engaging base 20 is most preferably planar, it will be understood herein that ground engaging base 20 may in some alternative embodiments have a non-planar geometry. For exemplary and non limiting purpose ground engaging base 20 may in some alternative embodiments incorporate waves, ripples, or other non-planar features, which in those alternative embodiments can be used to facilitate orientation of ground engaging base 20 in a horizontal plane, even when in contact with an uneven ground surface.

Riser 30 consists of longitudinally extensive riser members 31, 32, 33, 34 fabricated from rod stock. The open space provided between each of the riser members 31, 32, 33, 34 simultaneously provides good ventilation and good access for placing of kindling materials and igniting the kindling. Nevertheless, in alternative embodiments more extensive framework or even expanded metal or lattice work may be preferred.

In preferred embodiment fire stump 10, upper firewood support 40 has been provided with four different and distinct components: a top generally planar surface distal to the ground or earth and distal to ground engaging base 20; firewood separators 41, 42, 43, 44; arcuate firewood supports 45, 46, 47, 48; and chimney hole 49. Nevertheless, and like ground engaging base 20, upper firewood support 40 is of unitary construction, and may be fabricated from standard sheet stock such as by stamping using suitable dies, substantially reducing the labor and difficulty of fabrication. Once again and like ground engaging base 20, in alternative embodiments upper firewood support 40 may alternatively be fabricated from rod, wire, or any other suitable stock materials. When so fabricated in these alternative embodiments, the geometry of alternative embodiment upper firewood support 40 may be altered to better suit the materials or desire of a designer.

Firewood separators 41, 42, 43, 44 work in conjunction with arcuate firewood supports 45, 46, 47, 48 to hold and retain firewood 2, without any special effort or balancing by a fire starter. The concave geometry of arcuate firewood supports 45, 46, 47, 48 ensure that any firewood resting against these supports will be urged through gravity toward a vertical axis passing through the center of chimney hole 49. Since firewood separators 41, 42, 43, 44 are farther from the vertical central axis discussed above, firewood 2 will not accidentally topple away from or out of the fire, and instead will fall toward the central axis. This will occur even as the fire is burning, thereby significantly improving both the ease of placing the firewood and the safety of the resulting fire.

As a beneficial result, a person can manually hold a fresh log 2 with fingers from one hand on the top face and fingers from the other hand on the bottom face of the firewood, along a vertical line most distal to the vertical surface closest to the flame. The firewood 2 shields the person's hands from the radiant energy of the fire. When the firewood 2 is lowered onto ground engaging base 20, the person's fingers holding the bottom face can be removed. Next, the person can remove their fingers from the top while giving firewood 2 a slight nudge toward the vertical central axis, causing firewood 2 to lean into upper firewood support 40, thereby dropping into one of arcuate firewood supports 45-48 and falling toward the central axis.

Firewood separators 41, 42, 43, 44 each also have a slight increase in width distal to chimney hole 49, as clearly illustrated in FIG. 2. This optional increase in width is preferred, and facilitates the formation of small holes during the same stamping operation that defines arcuate firewood supports 45, 46, 47, 48 and chimney hole 49. When so formed, it is a simple matter at the time of fabrication to insert riser members 31, 32, 33, 34 into these small holes, and then to affix them therein such as by welding.

Similar small holes may likewise be stamped or otherwise formed into ground engaging base 20, for like purpose. In preferred embodiment fire stump 10, these small holes are formed into ground engaging base 20 adjacent a juncture of each one of said four longitudinally extensive base support members 21, 22, 23, 24.

In preferred embodiment fire stump 10, riser members 31, 32, 33, 34 pass into, but not through, the small holes in ground engaging base 20 and in upper firewood support 40. However, in some alternative embodiments one or more of these riser members 31, 32, 33, 34 may be dimensioned and located to pass through one or more of the small holes in ground engaging base 20 and in upper firewood support 40. For exemplary and non-limiting purpose, in some alternative embodiments riser members 31, 32, 33, 34 are dimensioned and located to pass through the small holes in ground engaging base 20, while still being rigidly affixed to these holes. The extra length of riser members 31, 32, 33, 34 form one or more legs that extend below ground engaging base. Again for exemplary and non-limiting purpose, such legs can offer utility when a person wishes to drive these leg extensions down into the earth or other surface to achieve better anchoring.

In preferred embodiment fire stump 10, chimney hole 49 is a simple circle which ensures a vertical chimney-like flow of air through the center of upper firewood support 40, even when a great deal of firewood 2 is stacked about preferred embodiment fire stump 10. Nevertheless, chimney hole 49 may take on any suitable geometry, including for exemplary and non-limiting purpose decorative or simulative geometries, or more simply a plurality of smaller holes or similar perforations.

While in some cases it will be preferable to provide kindling adjacent the earth, it is noteworthy that kindling or tinder may also or alternatively be provided on the top surface of upper firewood support 40. This allows a fire starter greater flexibility when the state of the ground surface is unsuitable, which for exemplary and non-limiting purpose might include the presence of water such as found along a beach, in a puddle, swamp, small stream or brook, or even with generally elevated water from rain.

As evident from FIGS. 2 and 3, the elevated planar surface defined by upper firewood support 40 may also be used in some instances as a support for cookware such as a pot or pan. When upper firewood support 40 is not or no longer required for support of tinder, and when ventilation through chimney hole 49 is not or no longer required, then a hot water or coffee pot, kettle, fry pan, skillet, or the like may be rested upon the elevated planar upper surface of upper firewood support 40. This upper generally or substantially planar surface of upper firewood support 40 provides an excellent open fire cook surface.

For the purposes of the present disclosure, surfaces referred to herein as planar will be understood to be generally or substantially planar. This means they may include surface features such as textures, diamond patterns, and other features that are sufficiently small of scale so as to not interfere with the support of a kettle or fry pan or similar cooking utensils. Furthermore, for most applications small holes or perforations will likewise not interfere with the support of a kettle or fry pan or similar cooking utensils. Consequently, and again for most but not all applications, perforations, indentations, or other features that do not consequentially alter the support of a kettle or fry pan or similar cooking utensils will be understood to still be generally or substantially planar.

As described herein above, preferred embodiment fire stump 10 may be readily manufactured in only a few relatively low cost and reliable steps. Standard rod stock may be cut to the length of risers 31-34. Ground engaging base 20 and upper firewood support 40 are most preferably stamped. If the geometries of FIG. 2 are used, the upper firewood support 40 fits entirely within the inner edge of ground engaging base 20, thereby being fully circumscribed by ground engaging base 20 when laid out in a single common sheet stock that yields both parts. As a result, production may comprise a single stamping operation or sequence to stamp both parts out of a single common sheet stock. This reduces manufacturing waste, while forming both parts using a low cost and highly efficient manufacturing method. Finally, risers 31-34, upper firewood support 40, and ground engaging base 20 are affixed together, such as by welding, brazing, or any other suitable technique appropriate for the particular materials used in the construction of preferred embodiment fire stump 10.

In another alternative embodiment, when upper firewood support 40 is entirely circumscribed by ground engaging base 20 when laid out in a single common sheet stock that yields both parts, in addition to the stamping operation or sequence to stamp both parts out of a single common sheet stock, a drawing operation may also be used to form riser 30. In such embodiment, a first stamping operation or sequence is used to create a total of five openings in the sheet stock. One opening in the center is identified as chimney hole 49. Four more openings are defined primarily by: arcuate firewood support 45 and longitudinally extensive base support member 22; arcuate firewood support 46 and longitudinally extensive base support member 23; arcuate firewood support 47 and longitudinally extensive base support member 24; and arcuate firewood support 48 and longitudinally extensive base support member 21. In this alternative embodiment, most preferably there are four strips of suitably dimensioned sheet metal that remain to connect ground engaging base 20 and upper firewood support 40. These same four strips complete the separation of the four openings just aforementioned, and would for exemplary purpose be positioned approximately in the positions such as illustrated in FIG. 2 by longitudinally extensive riser members 31, 32, 33, 34, but co-planar with both ground engaging base 20 and upper firewood support 40. At this stage, and only with proper tooling and proper selection of metal alloy and work history, and further limited to this alternative embodiment, a drawing die in concept similar to those used to fabricate metal soda pop cans is used to draw these four small strips of sheet metal into a greatly elongated geometry defining riser 30, while still preserving the parallel but offset planar geometries of ground engaging base 20 and upper firewood support 40. As may be apparent from this description of stamping and drawing dies, and the descriptions of wire forming and other manufacturing techniques, the present invention will be readily adapted to a wide variety of diverse manufacturing techniques that will be apparent to one skilled in the metal working arts upon a review of the present disclosure or analysis of the preferred or alternative embodiments.

Since in the preferred and nearly all alternative embodiments contemplated herein upper firewood support 40 fits entirely within the inner edge of ground engaging base 20, a plurality of preferred embodiment fire stumps 10 may be stacked upon each other in a vertical stack. In such case, the ground engaging base 20 of one fire stump 10 will encompass riser 30 of one (or more) of the next lower fire stump(s) 10 in the stack.

From the foregoing figures and description, several additional features and options become more apparent. First of all, preferred embodiment fire stump 10 may be manufactured from a variety of materials, including metals, ceramics or cementitious materials, or even combinations or composites of the above. The specific material used may vary, though special benefits are attainable if several important factors are taken into consideration. The components will most preferably be easily fabricated, and will withstand both the heat of the fire and weather. Furthermore, it is preferable that all materials are sufficiently tough and durable to not fracture, even when great forces are applied thereto, such as the accidental dropping of a piece of firewood 2 onto preferred embodiment fire stump 10. The selected material must work effectively with a desired set of manufacturing techniques, and so for exemplary and non-limiting purpose a brittle ceramic is not ordinarily compatible with the stamping described herein in association with the preferred embodiment fire stump 10. One exemplary material for preferred embodiment fire stump 10 is stainless steel, which has the advantages of being stain resistant, extremely tough and durable to withstand great force, easily manufactured, and heat resistant. Carbon steel offers lower cost, while preserving many of the aforementioned benefits of stainless steel. However, those skilled in the art of fireplaces and the like will recognize alternative materials that will be suitable as well, including but not limited to other ferrous and non-ferrous metals and alloys.

As should now be apparent, both of the upper firewood support 40 and ground engaging base 20 are preferably fabricated in a single stamping operation or sequence out of a single common sheet stock that yields both parts, thereby facilitating a low-cost and economically produced fire stump 10. Sheet steel is economical, fire resistant, and when shaped as illustrated, is strong but has relatively little weight. Since a plurality of fire stumps 10 may be stacked for inventory, shipment, and retail display, costs for inventory, shipment, and sales display are also relatively low. Nevertheless, a preferred embodiment fire stump 10 designed in accord with the teachings of the present invention retains the benefits of providing a reliable and stable support for firewood, with good "chimney effect" air flow, clustered firewood, good fire access and visibility, and even an upper surface to optionally cook upon or ignite tinder.

Preferred embodiment fire stump 10 is illustrated for exemplary and non-limiting purpose as having four faces, with each face defined by a corresponding base support member, adjacent risers, adjacent firewood separators, and an arcuate firewood support. As an example, one face is defined by longitudinally extensive base support member 21, longitudinally extensive riser members 31, 34, firewood separators 41, 44, and arcuate firewood support 48. Nevertheless, the number of faces is not critical to the present invention, and alternative embodiments may comprise fewer or more faces. In further alternative embodiments, the size of the faces is not equal, and some faces may be taller, shorter, wider, or narrower than others.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A fire stump, comprising:

a sheet steel ground engaging base having an open center;

a sheet steel upper firewood support stamped from said sheet steel ground engaging base to thereby define at least a portion of said base open center, said upper firewood support having a perforate center defining a chimney hole and a perimeter defining a plurality of concave arcuate firewood supports, each one of a pair of adjacent firewood supports separated from each other by a firewood separator more distal to said perforate center than said each one of said pair of adjacent firewood supports; and a riser rigidly coupling and displacing said sheet steel upper firewood support to a plane displaced above and parallel with a plane defined by said sheet steel ground engaging base.

2. The fire stump of claim 1, wherein said sheet steel ground engaging base is planar.

3. The fire stump of claim 2, wherein said sheet steel upper firewood support is planar.

4. The fire stump of claim 3, wherein said sheet steel ground engaging base comprises four longitudinally extensive base support members, each of said four longitudinally extensive base support members integral with and perpendicular to adjacent ones of said four longitudinally extensive base support members and thereby defining square interior and exterior perimeters of said ground engaging base and four corners, each one of said four corners located between each one of said four longitudinally extensive base support members.

5. The fire stump of claim 4, wherein said riser comprises four longitudinally extensive riser members, each one coupling at a first end with a one of said firewood separators and at a second distal end with said sheet steel planar ground engaging base adjacent a one of said four corners.

6. The fire stump of claim 5, wherein each one of said four ground engaging base corners further comprises a hole stamped through said ground engaging base, each one of said firewood separators further comprises a hole stamped through said upper firewood support, and said riser comprises four rods, each one of said four rods filling a one of said ground engaging base corner holes adjacent a first end and extending longitudinally therefrom to a second distal end filling a one of said firewood separator holes.

7. The fire stump of claim 6, wherein at least one of said four rods extends longitudinally from said upper firewood support to and beyond said planar ground engaging base.

8. The fire stump of claim 5, wherein said riser comprises four sheets, each one of said four sheets coupling with a one of said ground engaging base corners adjacent a first end and extending longitudinally therefrom to a second distal end coupling with a one of said firewood separators.

9. The fire stump of claim 8, wherein each one of said four sheets is metal drawn from said sheet steel planar ground engaging base.

10. In combination, a fire stump and firewood, said fire stump comprising:

a sheet steel planar ground engaging base having an open center and four longitudinally extensive base support members, each of said four longitudinally extensive base support members integral with and perpendicular to adjacent ones of said four longitudinally extensive base support members and thereby defining square interior and exterior perimeters of said ground engaging base and four corners, each one of said four corners located between each one of said four longitudinally extensive base support members;

a sheet steel planar upper firewood support stamped from said sheet steel planar ground engaging base to thereby define at least a portion of said base open center, said upper firewood support having a perforate center defining a chimney hole and a perimeter defining a plurality of concave arcuate firewood supports, each one of a pair of adjacent firewood supports separated from each other by a firewood separator more distal to said perforate center than said each one of said pair of adjacent firewood supports; and a riser rigidly coupling and displacing said sheet steel planar upper firewood support to a plane displaced above and parallel with a plane defined by said sheet steel planar ground engaging base, said riser having four longitudinally extensive riser members, each one coupling at a first end with a one of said firewood separators and at a second distal end with said sheet steel planar ground engaging base adjacent a one of said four corners;

said firewood comprising:

a generally cylindrical wooden body defining first and second distal ends, said firewood first end resting on said ground engaging base, said firewood second end rising from said ground engaging base to an elevation above said upper firewood support and more distal to said ground engaging base, a side of said generally cylindrical wooden body resting within a one of said plurality of concave arcuate firewood supports.

11. The combination fire stump and firewood of claim 10, wherein each one of said four ground engaging base corners further comprises a hole stamped through said ground engaging base, each one of said firewood separators further comprises a hole stamped through said upper firewood support, and said riser comprises four rods, each one of said four rods filling a one of said ground engaging base corner holes adjacent a first end and extending longitudinally therefrom to a second distal end filling a one of said firewood separator holes.

12. The combination fire stump and firewood of claim 11, wherein at least one of said four rods extends longitudinally from said upper firewood support to and beyond said planar ground engaging base.

13. The combination fire stump and firewood of claim 10, wherein said riser comprises four sheets, each one of said four sheets coupling with a one of said ground engaging base corners adjacent a first end and extending longitudinally therefrom to a second distal end coupling with a one of said firewood separators.

14. The combination fire stump and firewood of claim 13, wherein each one of said four sheets is metal drawn from said sheet steel planar ground engaging base.

15. In combination, a fire stump and firewood, said fire stump comprising:

a sheet steel ground engaging base having an open center;

a sheet steel upper firewood support stamped from said sheet steel ground engaging base to thereby define at least a portion of said base open center, said upper firewood support having a perforate center defining a chimney hole and a perimeter defining a plurality of concave arcuate firewood supports, each one of a pair of adjacent firewood supports separated from each other by a firewood separator more distal to said perforate center than said each one of said pair of adjacent firewood supports; and a riser rigidly coupling and displacing said sheet steel upper firewood support to a plane displaced above and parallel with a plane defined by said sheet steel ground engaging base;

said firewood comprising:

a generally cylindrical wooden body defining first and second distal ends, said firewood first end resting on said ground engaging base, said firewood second end rising from said ground engaging base to an elevation above said upper firewood support and more distal to said ground engaging base, a side of said generally cylindrical wooden body resting within a one of said plurality of concave arcuate firewood supports.

16. The combination fire stump and firewood of claim 15, wherein said sheet steel ground engaging base is planar and said sheet steel upper firewood support is planar.

17. The combination fire stump and firewood of claim 16, wherein said sheet steel ground engaging base comprises four longitudinally extensive base support members, each of said four longitudinally extensive base support members integral with and perpendicular to adjacent ones of said four longitudinally extensive base support members and thereby defining square interior and exterior perimeters of said ground engaging base and four corners, each one of said four corners located between each one of said four longitudinally extensive base support members.

18. The combination fire stump and firewood of claim 17, wherein said riser comprises four longitudinally extensive riser members, each one coupling at a first end with a one of said firewood separators and at a second distal end with said sheet steel planar ground engaging base adjacent a one of said four corners.

19. The combination fire stump and firewood of claim 18, wherein each one of said four ground engaging base corners further comprises a hole stamped through said ground engaging base, each one of said firewood separators further comprises a hole stamped through said upper firewood support, and said riser comprises four rods, each one of said four rods filling a one of said ground engaging base corner holes adjacent a first end and extending longitudinally therefrom to a second distal end filling a one of said firewood separator holes.

20. The combination fire stump and firewood of claim 19, wherein at least one of said four rods extends longitudinally from said upper firewood support to and beyond said planar ground engaging base.

* * * * *